US008671475B2

(12) United States Patent
Radzinsky

(10) Patent No.: US 8,671,475 B2
(45) Date of Patent: Mar. 18, 2014

(54) APPARATUS AND METHODS FOR TRANSFERRING A PATIENT

(76) Inventor: Yevgeniy Radzinsky, Brooklyn, NY (US)

( * ) Notice: Subject to any disclaimer, the term of this patent is extended or adjusted under 35 U.S.C. 154(b) by 537 days.

(21) Appl. No.: 12/881,843

(22) Filed: Sep. 14, 2010

(65) Prior Publication Data

US 2012/0060277 A1 Mar. 15, 2012

(51) Int. Cl.
*A61G 1/00* (2006.01)

(52) U.S. Cl.
USPC ..... 5/89.1; 5/81.1 R; 5/85.1; 5/628

(58) Field of Classification Search
USPC ..... 5/89.1, 81.1 T, 81.1 R, 625–629, 85.1; 296/20
See application file for complete search history.

(56) References Cited

U.S. PATENT DOCUMENTS

| | | | | |
|---|---|---|---|---|
| 2,387,082 | A | 10/1945 | Mailing | |
| 2,738,939 | A * | 3/1956 | Johnson | 244/137.2 |
| 2,969,210 | A * | 1/1961 | Richardson et al. | 244/137.2 |
| 3,228,044 | A * | 1/1966 | Mattenson | 441/83 |
| 3,934,847 | A * | 1/1976 | Bentivegna | 244/137.2 |
| 4,043,468 | A | 8/1977 | Shea | |
| 4,564,161 | A * | 1/1986 | Frye | 244/137.2 |
| 4,599,074 | A * | 7/1986 | Beckly | 441/80 |
| 4,736,906 | A * | 4/1988 | Taillet | 244/1 A |
| 4,750,691 | A * | 6/1988 | Hollrock et al. | 244/137.1 |
| 4,753,620 | A * | 6/1988 | Arney | 441/83 |
| 5,018,931 | A | 5/1991 | Uttley | |
| 5,020,742 | A * | 6/1991 | Haslim | 244/137.2 |
| 5,022,105 | A | 6/1991 | Catoe | |
| 5,365,622 | A | 11/1994 | Schirmer | |
| 5,431,526 | A | 7/1995 | Peterson et al. | |
| 6,024,528 | A | 2/2000 | Taylor | |
| 6,176,672 | B1 * | 1/2001 | Egan et al. | 414/462 |

(Continued)

FOREIGN PATENT DOCUMENTS

| | | | |
|---|---|---|---|
| DE | 10251962 | A1 | 5/2004 |
| DE | 202006012125 | U1 | 2/2007 |
| GB | 2451154 | A | 1/2009 |

OTHER PUBLICATIONS

"Notification of Transmittal of the International Search Report and the Written Opinion of the International Searching Authority, or the Declaration," International Filing Date: Sep. 13, 2011, International Application No. PCT/US2011/001571, Applicant: Radzinsky, Yevgeniy, Date of Mailing: Feb. 14, 2012, pp. 1-13.

*Primary Examiner* — Robert G Santos
*Assistant Examiner* — David E Sosnowski
(74) *Attorney, Agent, or Firm* — Cesari and McKenna, LLP

(57) ABSTRACT

In one embodiment, an example patient movement apparatus and methods for its use enable an EMS crew to load a patient disposed in an ambulance chair and/or in an ambulance stretcher into an ambulance, unload the patient from the ambulance, and otherwise move the patent within the ambulance, for example, from the ambulance chair to the ambulance stretcher. The patient movement apparatus may comprise a patient cradle in which a patient is wrapped, a loading ramp that spans between ground level and the level of the floor of the rear of the ambulance, a winch secured within the rear of the ambulance and having a retractable winch cable, an articulating arm secured within the rear of the ambulance and having a pulley to accommodate the winch cable, and/or one or more cable guides secured within the rear of the ambulance and that accommodate the winch cable.

10 Claims, 14 Drawing Sheets

(56) References Cited

U.S. PATENT DOCUMENTS

| | | | | |
|---|---|---|---|---|
| 6,289,534 | B1 * | 9/2001 | Hakamiun et al. | 5/89.1 |
| 6,381,781 | B1 | 5/2002 | Bourgraf et al. | |
| 6,637,610 | B1 * | 10/2003 | Cheeseboro | 212/327 |
| 6,675,412 | B2 * | 1/2004 | Faucher et al. | 5/83.1 |
| 6,837,669 | B2 * | 1/2005 | Reed et al. | 414/537 |
| 6,908,131 | B2 | 6/2005 | Main et al. | |
| 6,916,056 | B2 | 7/2005 | Mitchell et al. | |
| 7,111,340 | B2 * | 9/2006 | Mitchell et al. | 5/185 |
| 7,168,110 | B2 * | 1/2007 | Girard et al. | 5/89.1 |
| 7,237,491 | B2 * | 7/2007 | Faucher et al. | 104/89 |
| 7,284,745 | B2 * | 10/2007 | Keane et al. | 254/372 |
| 7,392,975 | B2 * | 7/2008 | Nespor | 254/326 |
| 7,478,855 | B2 | 1/2009 | Lambarth et al. | |
| 7,520,551 | B2 | 4/2009 | Lambarth et al. | |
| 7,563,065 | B1 * | 7/2009 | Bennett | 414/500 |
| 7,627,912 | B1 | 12/2009 | McKinney | |
| 2003/0084508 | A1 * | 5/2003 | Faucher et al. | 5/81.1 R |
| 2004/0202533 | A1 | 10/2004 | Haire | |
| 2007/0122260 | A1 | 5/2007 | Zablocky et al. | |
| 2010/0045059 | A1 | 2/2010 | Bourgraf et al. | |
| 2010/0229299 | A1 * | 9/2010 | Lear | 5/89.1 |
| 2011/0260482 | A1 | 10/2011 | Bourgraf et al. | |
| 2012/0060277 | A1 * | 3/2012 | Radzinsky | 5/89.1 |
| 2012/0174315 | A1 * | 7/2012 | Gurinowitsch | 5/83.1 |

* cited by examiner

APPARATUS AND METHODS FOR TRANSFERRING A PATIENT

BACKGROUND

1. Technical Field

The present disclosure relates generally to patient transfer, and more specifically to apparatus and methods for loading into, unloading from, and otherwise moving a patent within, an ambulance.

2. Background Information

The work duties of an emergency medical services (EMS) crew typically comprise two primary tasks: patient medical care and patient transfer. Patient transfer typically includes a number of steps. When an EMS crew arrives at a scene (e.g., a house, a street, a workplace, etc. where an injured person is located) the EMS crew often first transfers the patent to an ambulance chair to move the patient to the ambulance. Once moved to the ambulance, the EMS crew then loads the patient into the rear of the ambulance. The patient is typically transferred from the ambulance chair to an ambulance stretcher at this point. After driving the patient in the ambulance to a hospital, the EMS crew unloads the patient and ambulance stretcher from the rear of the ambulance, and transfers the patient from the ambulance stretcher to a hospital stretcher, to bring the patient inside of the facility.

While patient medical care has improved dramatically over time, the logistics of patient transfer have progress little in the last fifty years. Typically, most of the lifting and movement of the patient is performed manually by the EMS crew. The heavy lifting needed to move the patient often involves significant twisting and other unnatural movements, sometimes in confined spaces within the rear of the ambulance. This may lead to spine injuries, hernias and/or other traumas for the EMS crew, and pose dangers to patients from accidental drops and mishandling.

More specifically, while in some situations it may be possible to load a patient directly into an ambulance stretcher, often the above described step of first loading a patient into an ambulance chair is necessary. An ambulance chair typically may be maneuvered through tight quarters, and fit within standard elevators. In contrast, use of an ambulance stretcher is often limited to open areas and structures with wide hallways and freight elevators, which can accommodate the size of the ambulance stretcher. After moving the ambulance chair near the ambulance, the EMS crew typically manually lifts the chair and patient together into the rear of the ambulance. With a typical ambulance, the chair and patient may need to be lifted as much as 33 inches above ground level to the level of the interior floor of the rear of the ambulance. The height of such lift causes this movement to be a significant source of injury for the EMS crew, as well as a potential danger to a patient, who may be inadvertently dropped or mishandled.

After the patient and ambulance chair are loaded into the rear of the ambulance, the patient is typically transferred from the ambulance chair to the ambulance stretcher. Typically, this operation is performed manually by a single EMS crew member, who embraces the patient around the chest, lifts the patient from the ambulance chair, and then performs a twisting movement to transfer the patient to the ambulance stretcher located along side the ambulance chair. This movement is typically an even greater source of injury for the EMS crew than the initial lift into the ambulance, as one crew member must lift all the patient's weight, while twisting inside a confined space. In particular, this twisting motion is a common source of spinal injuries for EMS crew members, as well as a common source of patient drop accidents.

Previous attempts to address the problems encountered in patient transfer have suffered shortcomings, which have limited their use and acceptance by EMS crews. For example, various types of hydraulic stretcher lifts have been developed that can vertically raise an ambulance stretcher from ground level to the level of the floor of the rear of the ambulance. However, such hydraulic stretcher lifts do not address the problem of transferring a patient from an ambulance chair to an ambulance stretcher. As discussed above, it is often impractical to initially load a patient into an ambulance stretcher rather than an ambulance chair, and transfer of the patient between the ambulance chair to the ambulance stretcher typically cannot be avoided. This transfer, however, is not aided by a hydraulic stretcher lift, leaving a difficult manual lift to still to be performed by an EMS crew member. Further, the hydraulic mechanisms commonly employed in hydraulic stretcher lifts are generally heavy, bulky and maintenance intensive. If maintenance is neglected, such lifts may be prone to fail mid-rise, creating a potentially unsafe situation, where manual completion of the lift is difficult, or unfeasible, for a two person EMS crew. Still further, such hydraulic stretcher lifts are often quite slow, and the time needed to deploy the lift, use the lift to load a patient, and re-stow the lift, may be unacceptable in a time-sensitive EMS response.

Accordingly, there is a need for improved techniques for loading a patent into, unloading a patent from, and otherwise moving a patent within, an ambulance.

SUMMARY OF THE INVENTION

In one embodiment, an example patient movement apparatus and methods for its use are provided that may enable an EMS crew to load a patient disposed in an ambulance chair and/or in an ambulance stretcher into an ambulance, unload the patient from the ambulance, and otherwise move the patent within the ambulance, for example, from the ambulance chair to the ambulance stretcher. The patient movement apparatus may comprise a number of components, including a patient cradle in which a patient is wrapped, a loading ramp that spans between ground level and the level of the floor of the rear of the ambulance, a winch secured within the rear of the ambulance and having a retractable winch cable with a removable attachment mechanism, an articulating arm secured within the rear of the ambulance and having a pulley to accommodate the winch cable, and/or one or more cable guides (forks) secured within the rear of the ambulance and that accommodate the winch cable. Methods of use of the example patient movement apparatus may differ depending upon whether the patient is to be initially loaded into an ambulance chair, or an ambulance stretcher, as required by conditions at the scene.

When an EMS crew arrives at the scene and determines an ambulance chair is to be initially used, the crew secures (e.g., wraps the patient in the patient cradle), and then places the patient into the ambulance chair. The loading ramp is deployed from the rear of the ambulance in a configuration that accommodates the ambulance chair. After moving the patient and ambulance chair proximate to the rear of the ambulance, the winch cable, if it is not already so disposed, is threaded through the pulley of the articulating arm, and removably secured to the ambulance chair, for example, with a carabineer or other removable attachment mechanism. The winch is activated, for example, by a remote control unit operated by an EMS crew member, and the patient and ambulance chair are pulled up the ramp, into the rear of the ambulance, absent manual lifting by the EMS crew.

Once inside the rear of the ambulance, the winch cable is detached from the ambulance chair, and the patient movement apparatus is used to transfer the patient from the ambulance chair to an ambulance stretcher. The winch cable is attached to lifting straps of the patient cradle, and the winch activated to lift the patient and cradle a small distance (e.g., about four inches) above the seat of the ambulance chair. While the patient is so lifted, the articulating arm is then articulated (e.g., rotated) so that the lifted patient is moved laterally to be disposed over the ambulance stretcher. The winch is then activated in the reverse direction to lower the patient (e.g., about 6 inches) to the level of the ambulance stretcher, and to ease the patient onto the ambulance stretcher, thereby completing the transfer absent significant manual exertion by the EMS crew.

When an EMS crew arrives at the scene and determines an ambulance stretcher can be initially used, the crew directly proceeds to place the patient into the ambulance stretcher. The loading ramp is deployed from the rear of the ambulance in a configuration that accommodates the ambulance stretcher. After moving the patient and ambulance stretcher proximate to the rear of the ambulance, the winch cable, if it is not already so disposed, is threaded through the one or more cable guides (forks) and removably secured to the ambulance stretcher, for example, with a carabineer or other removable attachment mechanism. The winch is activated, for example, by a remote control unit operated by a crew member, and the patient and ambulance stretcher are pulled up the ramp into the rear of the ambulance, absent manual lifting by the EMS crew. The patient and ambulance stretcher may be unloaded from the ambulance using similar techniques, simply operating the winch in the reverse direction.

It should be understood that various alternative embodiments are possible, and that this summery only describes some embodiments, of many possible embodiments of the invention disclosed herein. More detailed discussion of some alternative embodiments may be found further below.

BRIEF DESCRIPTION OF THE DRAWINGS

The description below refers to the accompanying drawings of an example embodiment, of which.

DETAILED DESCRIPTION OF AN EXAMPLE EMBODIMENT

Figure 1:
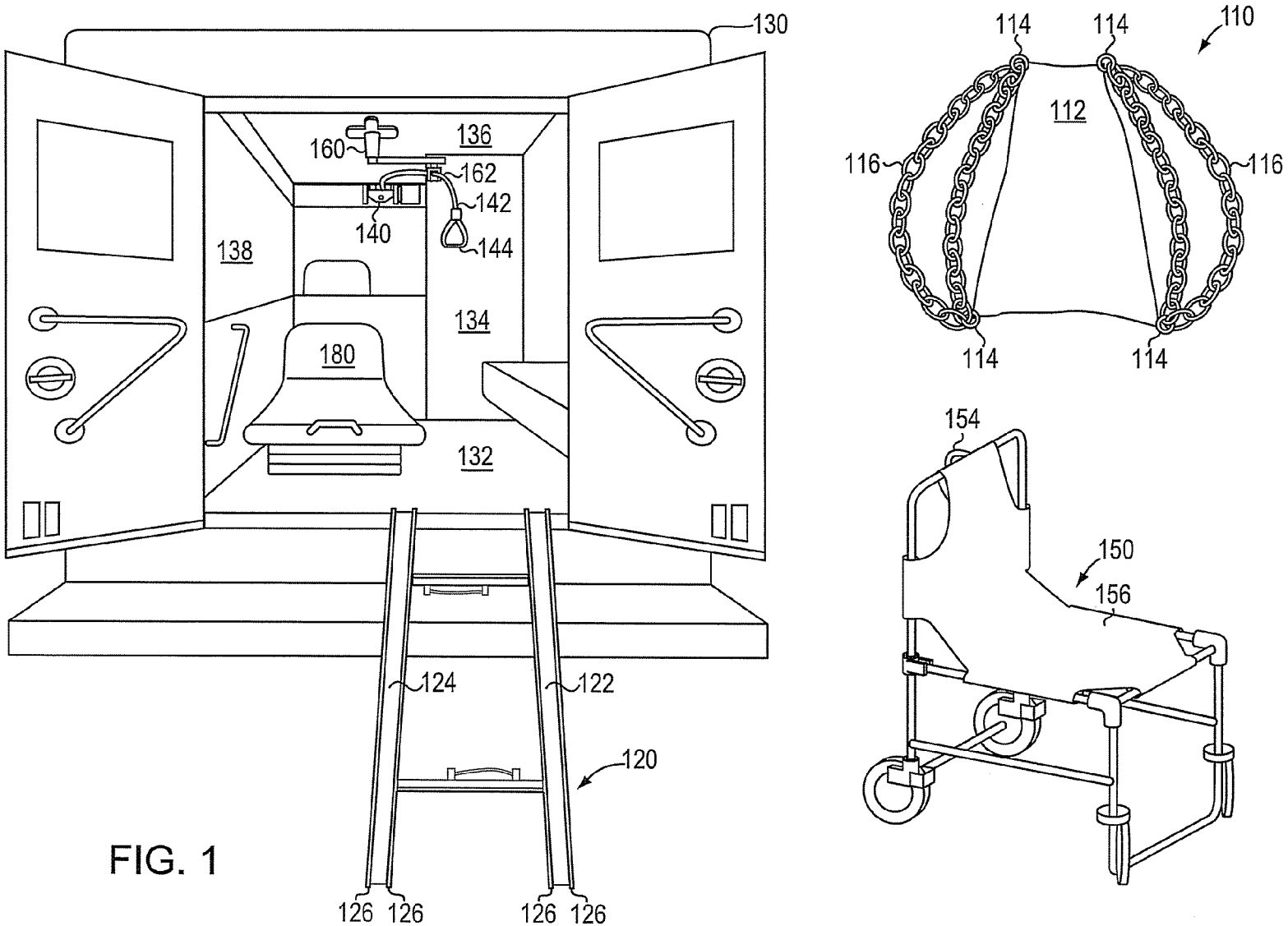
FIG. 1 is a perspective view showing example components of an example patient movement apparatus, which may be employed with an ambulance chair.

FIG. 1 is a perspective view showing example components of an example patient movement apparatus, which may be employed with an ambulance chair 150. The patient movement apparatus may comprise a number of components, including a special patient cradle 100 in which a patient is wrapped, a loading ramp 120 that spans between ground level and the level of the floor 132 of the rear of the ambulance 130, a winch 140 with a retractable winch cable 142 having a carabineer 144 or other removable attachment mechanism, an articulating arm 160 having a pulley 162 to accommodate the winch cable 142, and/or one or more cable guides (forks) 170 (obscured in FIG. 1, but see FIG. 14) that accommodate the winch cable 142.

The patient cradle includes a flexible seat 112 made from a strong, supple material, such as canvas, nylon fabric, or another material capable wrapping about the backside of a patient and supporting the weight of the patient. Attachment rings or grommets 114 are secured at a plurality of locations on the seat, for example, at the four corners. One or more lifting straps 116 are secured to the each of the attachment rings or grommets 114. The lifting straps 116 may be made from any of a variety of materials capable of supporting the weight of a patient, such as chain, nylon webbing, cabling and the like.

Figure 2:
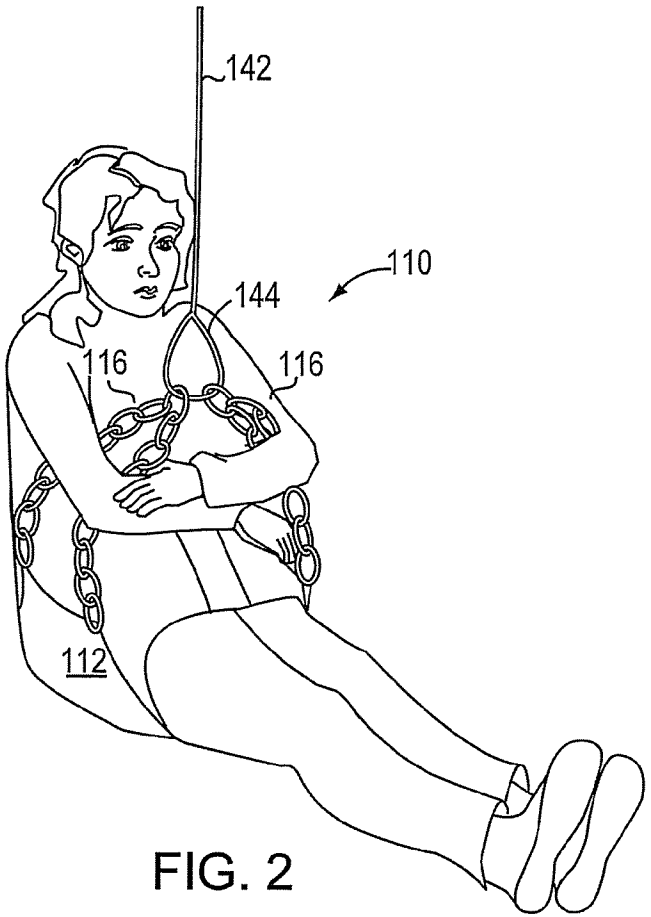
FIG. 2 is a perspective view showing a patient disposed within an example patient cradle being lifted.

FIG. 2 is a perspective view showing a patient disposed within an example patient cradle 100 and being lifted according to techniques described further below. When a patient is lifted, the lifting straps 116 may be drawn together, so a carabineer 144 or other removable attachment mechanism coupled to the winch cable 142 may be attached. The carabineer 144 may be attached to a particular ring, grommet, or the like disposed in the lifting straps 116. Alternatively, the carabineer 144 may simply be hooked around the lifting straps 116.

The loading ramp 120 is sized to span between ground level and the level of the floor 132 of the rear of the ambulance 130. The loading ramp 120 may include first and second tracks 122, 124 that accommodate wheels of the ambulance chair 150 and/or wheels of the ambulance stretcher 180. Guide lips 126 on the tracks 122, 124 may help retain the wheels in the tracks. In one configuration, the loading ramp 120 is an adjustable loading ramp, where the separation of the first and second tracks 122, 124 may be adjusted to accommodate the typically different separation of the wheels of the ambulance chair 150 and the ambulance stretcher 180.

Figure 3:
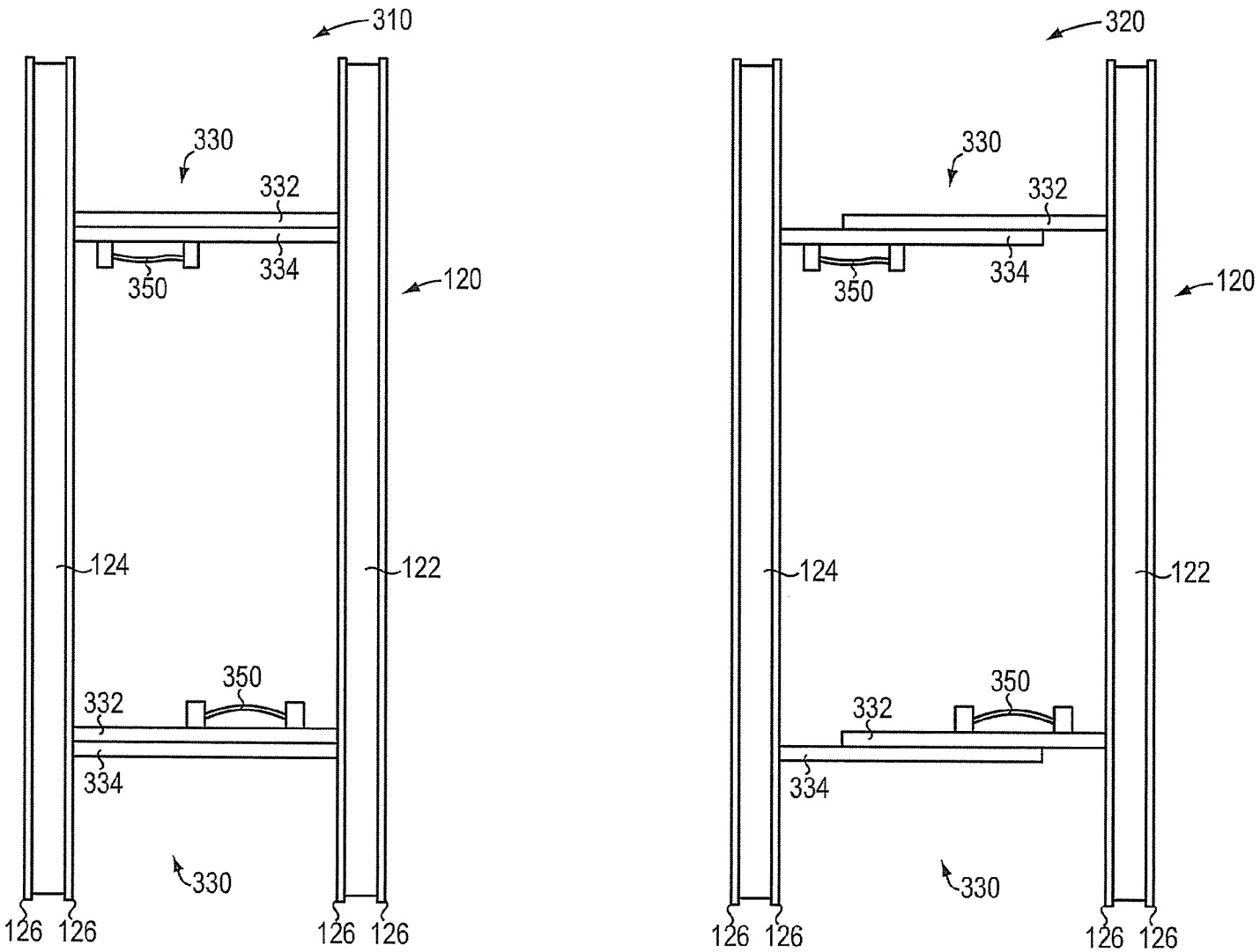
FIG. 3 is a perspective view showing an example adjustable loading ramp in first and second positions.

FIG. 3 is a perspective view showing an example adjustable loading ramp 120 in first and second positions 310, 320. Two or more crossbars 330, each of having first and second sliding members 332, 334, hold the first and second tracks 122, 124 substantially parallel to one another, while allowing changes in separation between the tracks. The sliding members 332, 334 of the crossbars 330 may adjust to a narrow first position, such that first and second tracks 122, 124 are spaced to accommodate the wheels of an ambulance chair 150. The tracks may be retained in the first position by springs 350 which draw the tracks together. Further pins (not shown) may be used to lock the tracks in place.

Further, the crossbars 310 may adjust to a wider second position 320, such that first and second tracks 122, 124 are spaced an appropriate width for the wheels of an ambulance stretcher 180. Further pins (not shown) may be used to lock the tracks in place.

The winch 140 with a retractable winch cable 142 is secured within the rear of the ambulance 130, for example, mounted to the interior front wall 134 within the rear of the ambulance. The winch 140 is preferable affixed into a frame beam along the interior front wall 134. However, in alternative embodiments, the winch 140 may be differently positioned, and affixed into different members. While a variety of types of winches may be employed, a remote-controlled, electrically powered, winch 140 is employed in the embodiment shown. Electrical power for the winch 140 may be supplied by the ambulance's electrical system, or, alternatively, from a separate dedicated power source.

The retractable winch cable 142 extends from the winch 140 and terminates with a carabineer 144 or other removable attachment mechanism. To prevent entanglement of the winch cable 142, a special double-roller mechanism may be employed to feed the winch cable to the spool of the winch 140.

Figure 4:
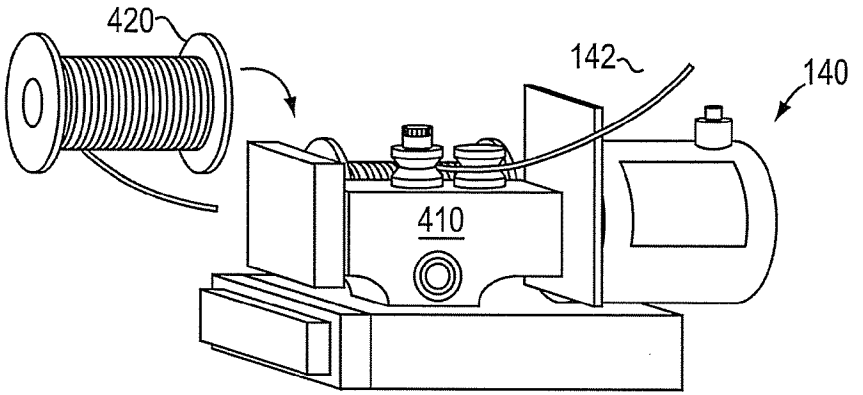
FIG. 4. is a perspective view showing an example double-roller mechanism that may be employed with the winch.

FIG. 4. is perspective view showing an example double-roller mechanism 410 that may be employed with the winch 140. The double-roller mechanism 410 may include first and second laterally-mounted rollers 420. The rollers 420 are spaced from one another sufficiently to allow the winch cable 142 to pass between the rollers, but to otherwise restrict substantial lateral movement of the winch cable 142 as it is fed towards the a spool 420 of the winch 140. In one embodiment, the lateral separation of the rollers 420 may be adjusted to be closer or farther apart. Such adjustment may help control alignment of the winch cable 142 on the spool 420 of the winch 140, while coiling or uncoiling the cable, thereby reducing the occurrence of tangles and "bird's nests" on the spool 420. Adjustment of the rollers 420 may also allow modification of the length of the winch cable 142. For example, adjustment of the rollers 420 to be closer to one another may permit a longer cable to be accommodated on the spool 420 than the cable for which the winch 140 was originally designed. Finally, adjustment of the rollers 420 may allow the winch cable 142 to be pulled in various directions (rather than only perpendicular to the major axis of the spool 420) while avoiding cable entanglement. Such ability may be advantageous when operating in confined spaces.

The winch cable 142 may extend directly from the double-roller mechanism 410 to a pulley 162 of the articulating arm 160, or may first pass through a first cable guide (fork). In one configuration, the first cable guide is disposed on the ceiling 136 of the rear of the ambulance 130. Alternatively, the cable guide may be differently positioned.

Figure 5:
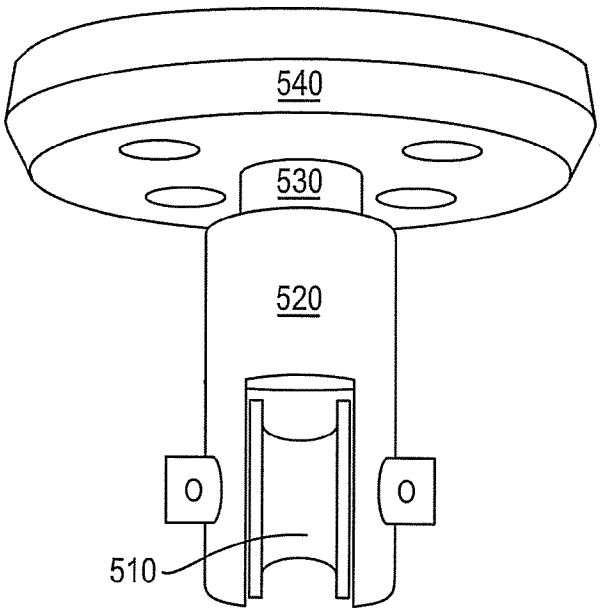
FIG. 5 is a perspective view showing an example cable guide (fork) that may be employed with a winch cable.

FIG. 5 is a perspective view showing an example cable guide (fork) 500 that may be employed with the winch cable 142. The example cable guide 500 may be used as the first cable guide discussed above and/or as a second cable guide, as discussed further below. The example cable guide 500 includes a pulley 510 mounted in a rotatable housing 520, that may rotate on a shaft 530 attached to a base 540. It should be apparent that a variety of other configurations may alternatively be employed to guide a cable 142.

The articulating arm 160 having a pulley 162 may be secured to the ceiling 136 of the rear of the ambulance 130, for example, into a structural beam disposed in the ceiling 136. Alternatively, the articulating arm 160 may be differently secured, for example, into a side wall 138 of the rear of the ambulance 130. In either configuration, the pulley 162 is preferably disposed at a level higher than the ambulance chair 150, to support the winch cable 142 at a point sufficiently high to lift the patient from the chair 150.

Figure 6:
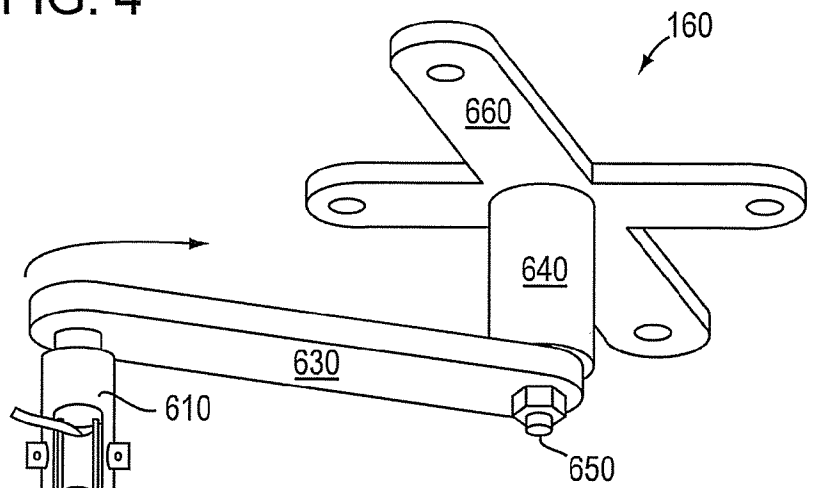
FIG. 6 is a perspective view showing an example articulating arm that may be employed with the winch cable.

FIG. 6 is a perspective view showing an example articulating arm 160 that may be employed with the winch cable 142. The pulley 162 of the articulating arm 160 is mounted in a rotatable housing 610 that may rotate on a shaft 620. The shaft 620 is coupled to a rotating member 630 attached to a riser 640 by a pivot 650. The rotating member 630 may rotate between multiple positions, including a first position suitable for lifting a patient off of the ambulance chair 150 inside the rear of the ambulance 130, and a second position suitable for lowering the patient onto the ambulance stretcher 180 inside the rear of the ambulance 130, as discussed in more detail below. The riser 640 may be attached to a base 660 that is secured to the ambulance 130. It should be apparent that a variety of other configurations of articulating arms may alternatively be employed, including arms with a greater, or lesser number, of articulating parts.

A second cable guide 170 (obscured in FIG. 1, but visible in FIG. 14) is secured in the rear of the ambulance 130, for example, into the floor 132. As explained further below, the second cable guide 170 may be used when loading an ambulance stretcher 180.

The afore described example patient movement apparatus may be employed by an EMS crew to load a patient disposed in an ambulance chair 150 and/or in an ambulance stretcher 180 into the ambulance 130, unload the patient from the ambulance 130, and otherwise move the patent within the ambulance, for example, from the ambulance chair 150 to the ambulance stretcher 180, absent significant manual lifting or other exertion by the EMS crew. By obviating the need for manual lifting, the incidence of spine injuries, hernias and/or other traumas for EMS crew members may be reduced. Further, patient safety may be improved, as the danger of accidental drops or other mishandling is minimized.

Figure 7:
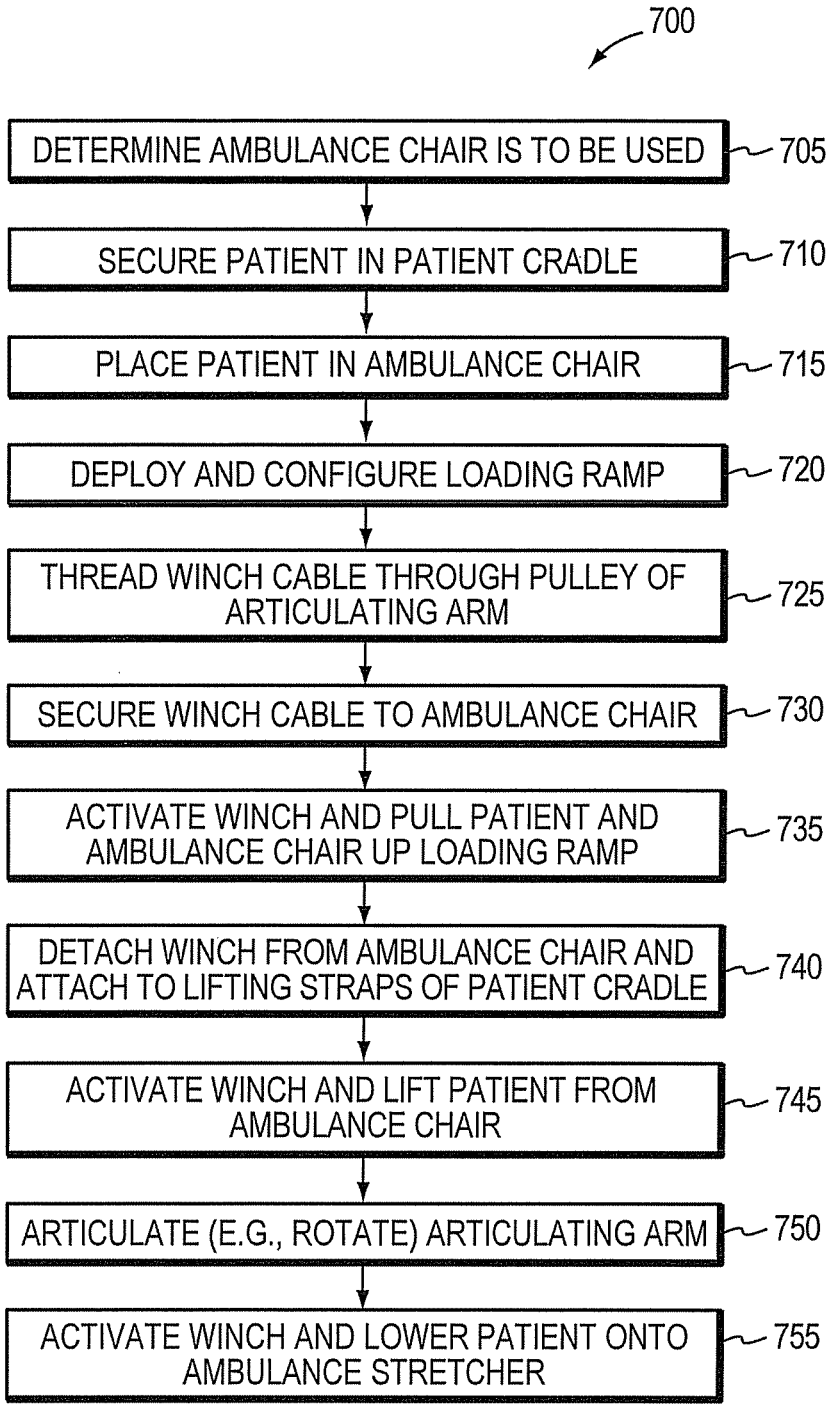
FIG. 7 is a flow diagram of an example sequence of steps for using the example patient movement apparatus to load a patient disposed in an ambulance chair into an ambulance and transferring the patient to an ambulance stretcher.

FIG. 7 is a flow diagram of an example sequence of steps 700 for using the example patient movement apparatus to load a patient disposed in an ambulance chair 150 into an ambulance 130 and transferring the patient to an ambulance stretcher 180. It should be apparent that at least some of the steps shown in FIG. 7 may be performed in a different order, and that, depending on the needs of EMS crew, some steps may not always to be performed. The steps 700 may be better understood with reference to the example progression shown in FIGS. 8-11 and the illustrations shown in FIG. 6 and FIG. 12.

Figure 8:
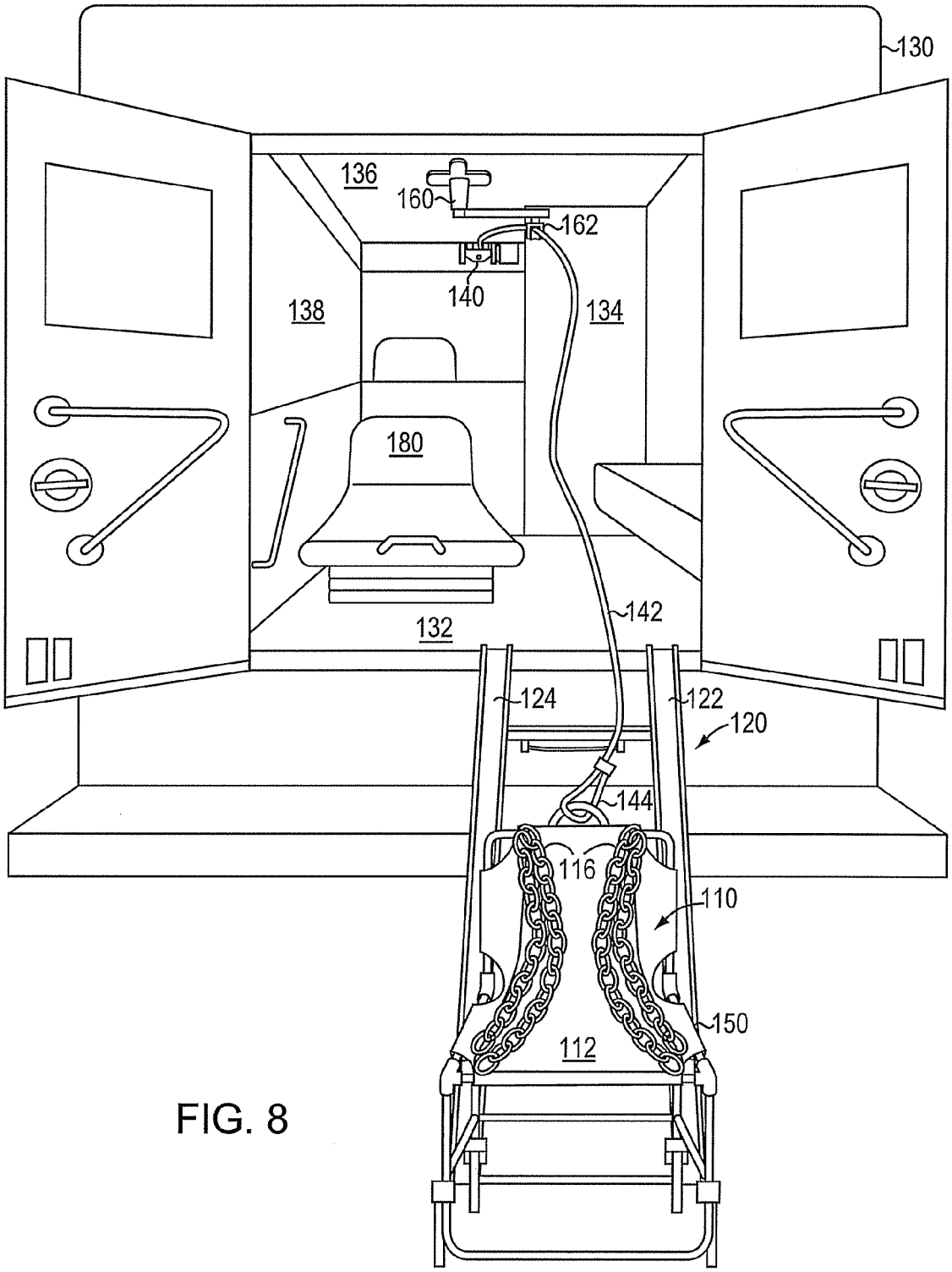
FIG. 8 is a perspective view of an example configuration with an ambulance chair in a first position, attached to a winch cable, and ready to loaded into the rear of an ambulance.
Figure 9:
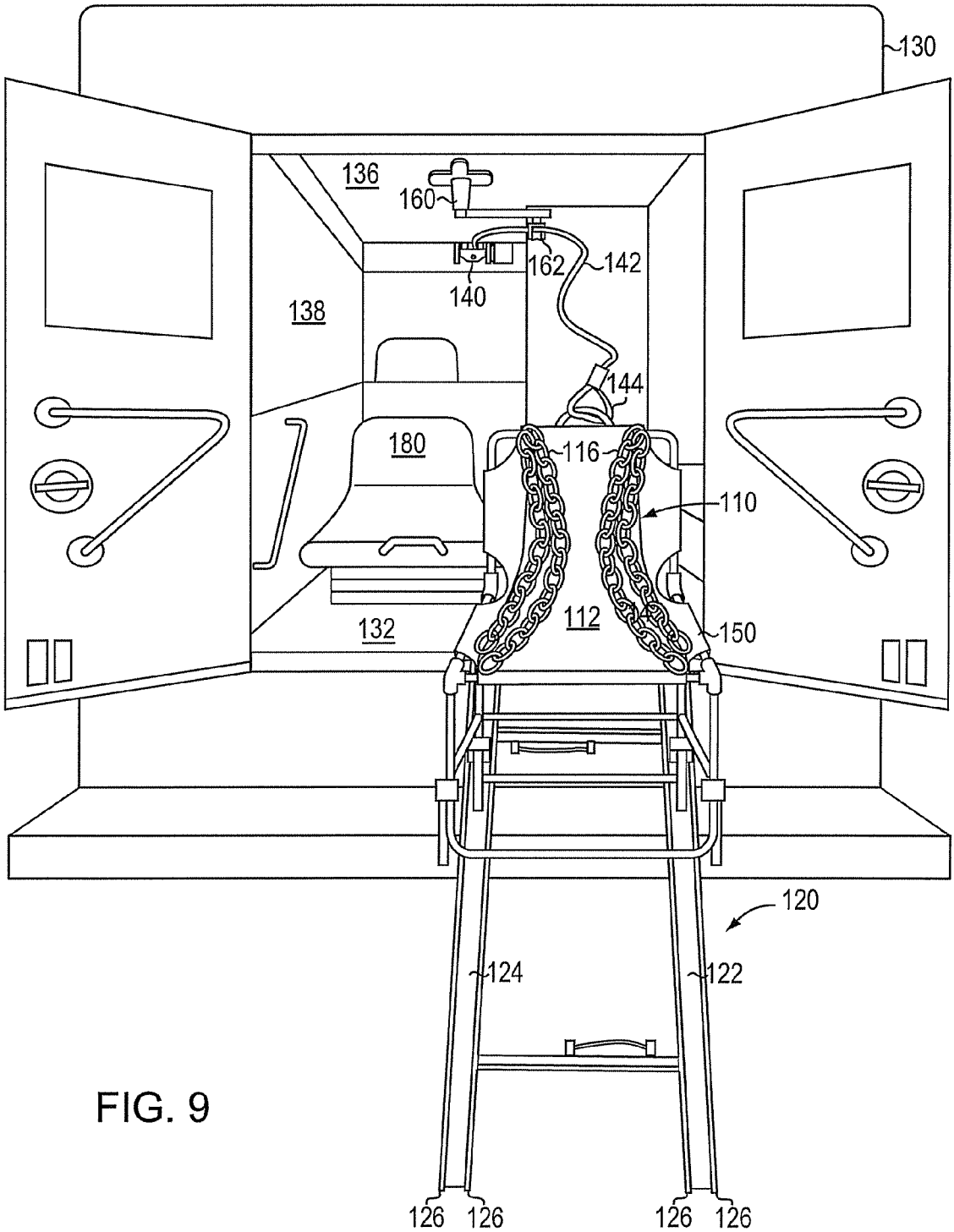
FIG. 9 is a perspective view of an example configuration with the ambulance chair in a second position, nearly in the rear of the ambulance.
Figure 10:
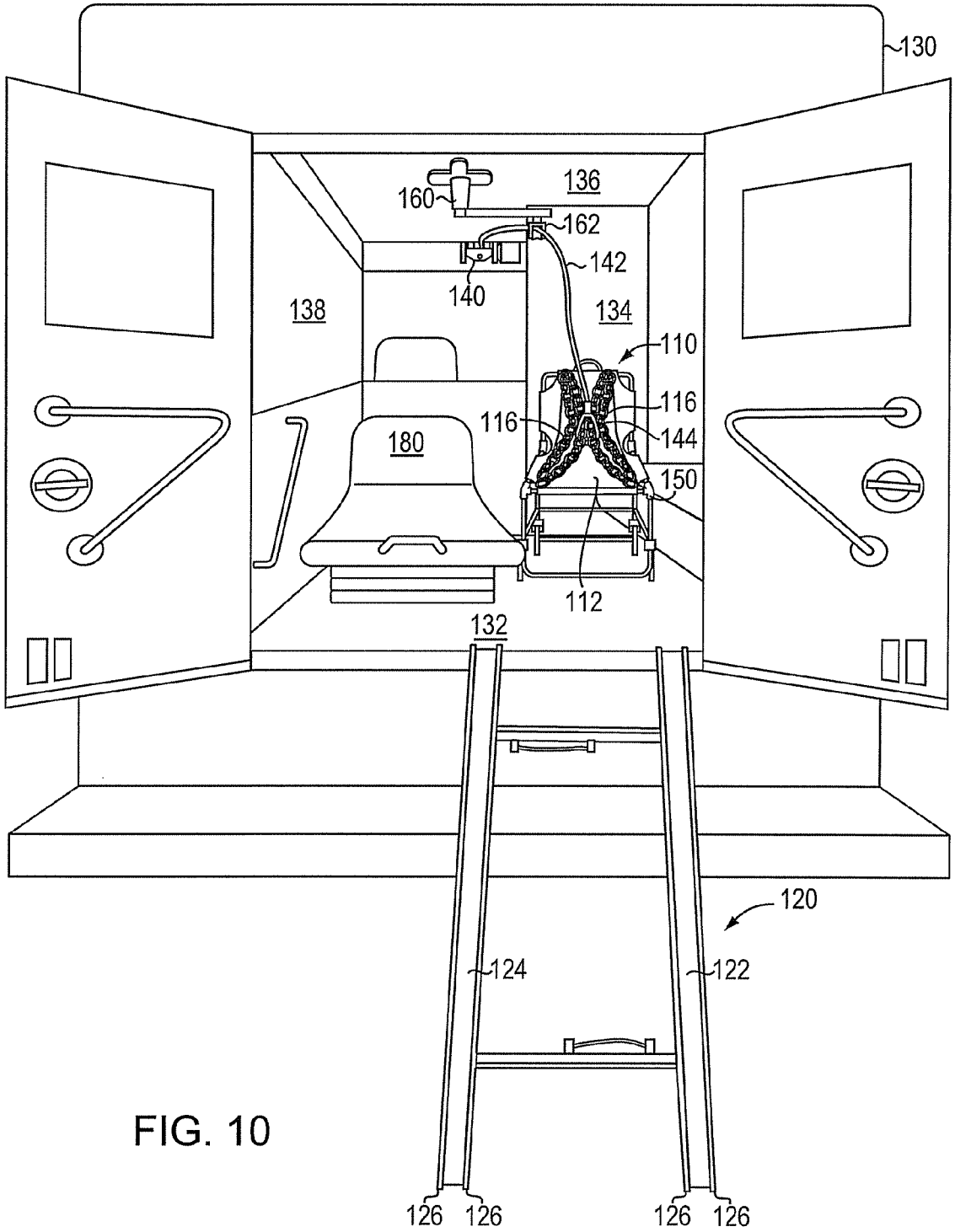
FIG. 10 is a perspective view of an example configuration with the ambulance chair in a third and final position, fully within the rear of the ambulance.

The sequence of steps 700 begins at step 705, where an EMS crew arrives at the scene and determines an ambulance chair 150 is to be initially used, for example, because an ambulance stretcher cannot be accommodated within hallways or elevators at the scene. At step 710, one or both of the EMS crew members may secure (e.g., wrap) the patient in the patient cradle 110. At step 715, the patient is placed into an ambulance chair 150. At step 720, the EMS crew deploys the loading ramp 120 from the rear of the ambulance 130, and adjusts the ramp so that the first and second tracks 122, 124 are in a configuration that accommodate the spacing of the wheels of the ambulance chair 150. At step 725, the winch cable 142, if it is not already so disposed, is threaded through the pulley 162 of the articulating arm 160, and, in some configurations, a first cable guide (fork). At step 730, after moving the patient and ambulance chair 150 proximate to the rear of the ambulance 130, the winch cable 142 is removably secured to the ambulance chair 150 with the carabineer 144 or other removable attachment mechanism, at an attachment point on the chair, for example, at a handle 154. The results of step 730 are shown in FIG. 8, which depicts an example configuration with the ambulance chair 150 in a first position, attached the winch cable 142, and ready to loaded into the rear of the ambulance 130. At step 735, the winch 140 is activated, for example, by a remote control unit operated by an EMS crew member, and the patient and ambulance chair 150 are pulled up the loading ramp 120 and into the rear of the ambulance 130, absent manual lifting by the EMS crew. FIG. 9, depicts an example configuration with the ambulance chair 150 in a second position, nearly in the rear of the ambulance 130. FIG. 10 depicts an example configuration with the ambulance chair 150 in a third and final position, fully within the rear of the ambulance 130.

Figure 12:
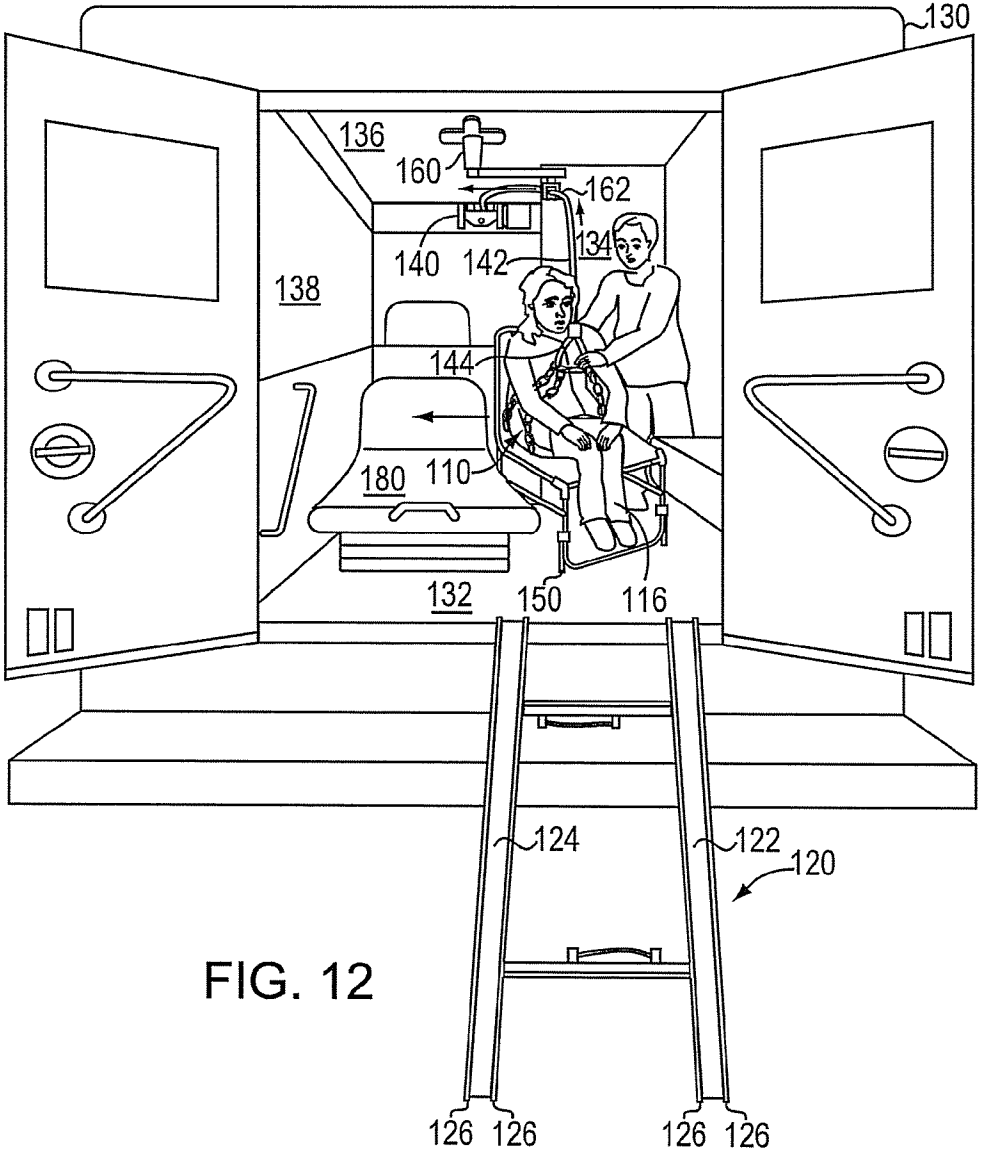
FIG. 12 is a perspective view of an EMS crew member rotating a lifted patient from the ambulance chair to the ambulance stretcher.
Figure 11:
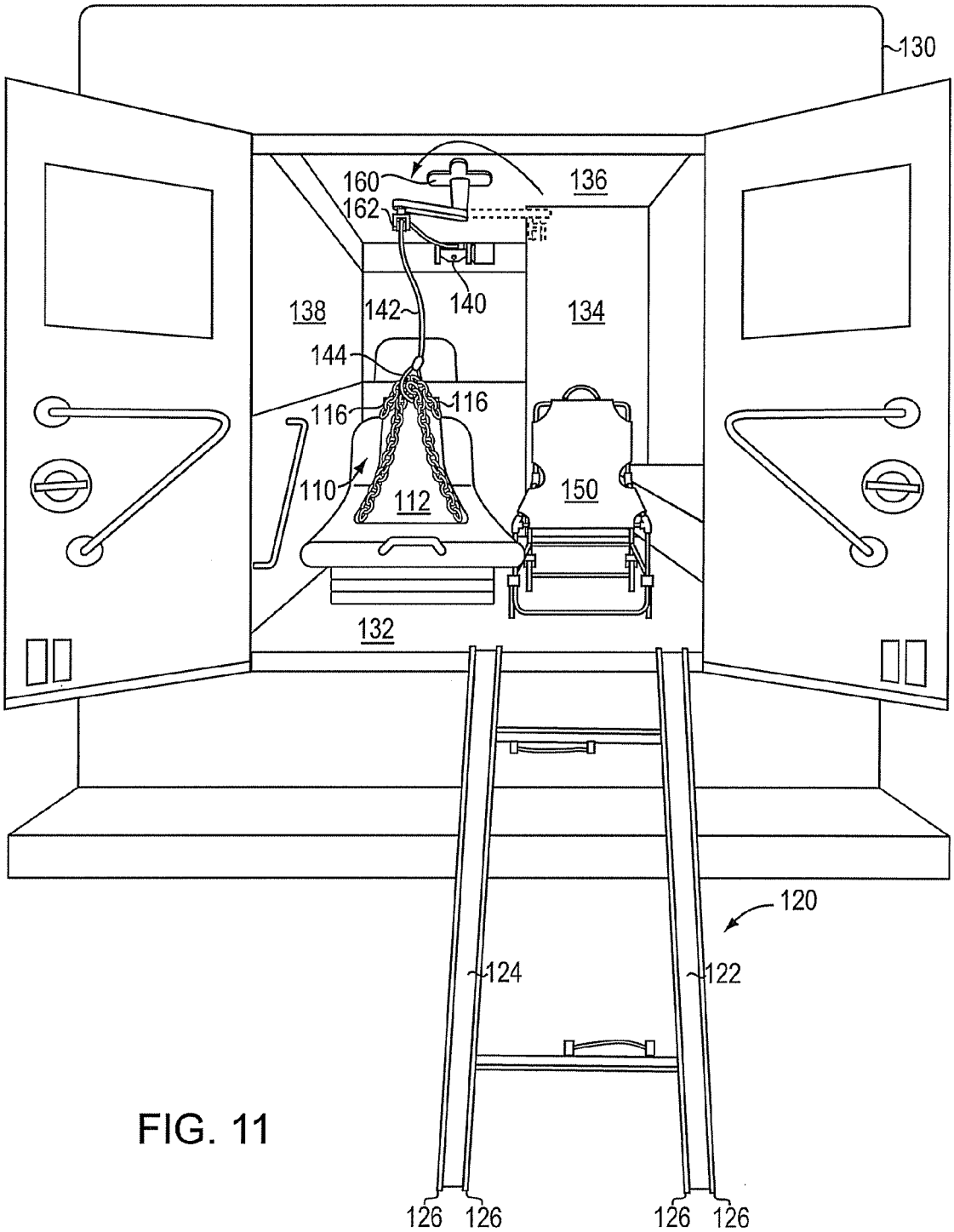
FIG. 11 is a perspective view of an example configuration with the articulating arm rotated through an arc, so that the patient cradle is disposed over the ambulance stretcher.

Once inside the rear of the ambulance, at step 740, the winch cable 142 is detached from the ambulance chair 150 and removable attached to the lifting straps 116 of the patient cradle 110. At step 745, the winch 140 is again activated, for example, via the remote control, to lift the patient cradle 110 and patient a small distance (e.g., about four inches) above the seat 156 of the ambulance chair 150. Such lifting may be seen in FIG. 2, introduced above. After the patient is so lifted, at step 750, the articulating arm 160 is articulated (e.g., rotated about 30 degrees), so that the patient cradle 110 and patient are moved to be disposed over the ambulance stretcher 180. FIG. 11, depicts an example configuration with the articulating arm 160 rotated through an arc 1110, so that the patient cradle 110 is disposed over the ambulance stretcher 180. Further, FIG. 12 depicts an example of an EMS crew member rotating a lifted patient from the ambulance chair 150 to the ambulance stretcher 180. At step 755, the winch is activated in the reverse direction to lower the patient cradle 110 and patient (e.g., about 6 inches) to the level of the ambulance stretcher 180, to ease the patient onto the stretcher. Thereby transfer to the ambulance stretcher 180 is completed, absent significant manual exertion by the EMS crew.

Figure 13:
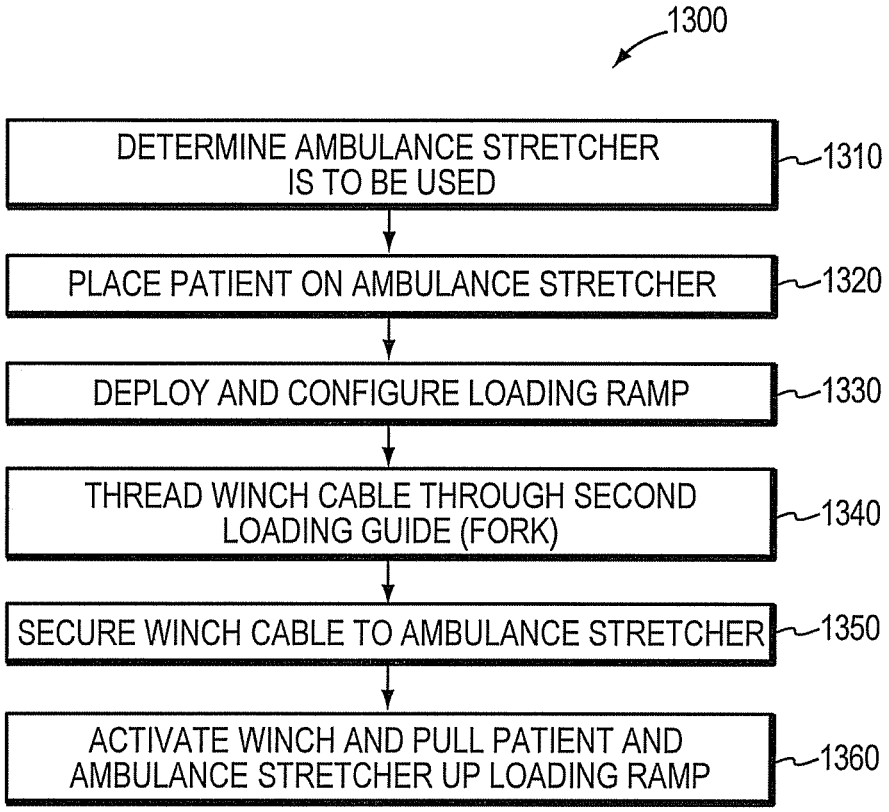
FIG. 13 is a flow diagram of an example sequence of steps for using the example patient movement apparatus to load a patient disposed in an ambulance stretcher into the ambulance.

FIG. 13 is a flow diagram of an example sequence of steps 1300 for using the example patient movement apparatus to load a patient disposed in an ambulance stretcher 180 into the ambulance 130. It should be apparent that at least some of the steps shown in FIG. 13 may be performed in a different order and that, depending on the needs of EMS crew, some steps may not always be performed. The sequence of steps 1300 may be better understood with reference to the example progression shown in FIGS. 14-17.

Figure 14:
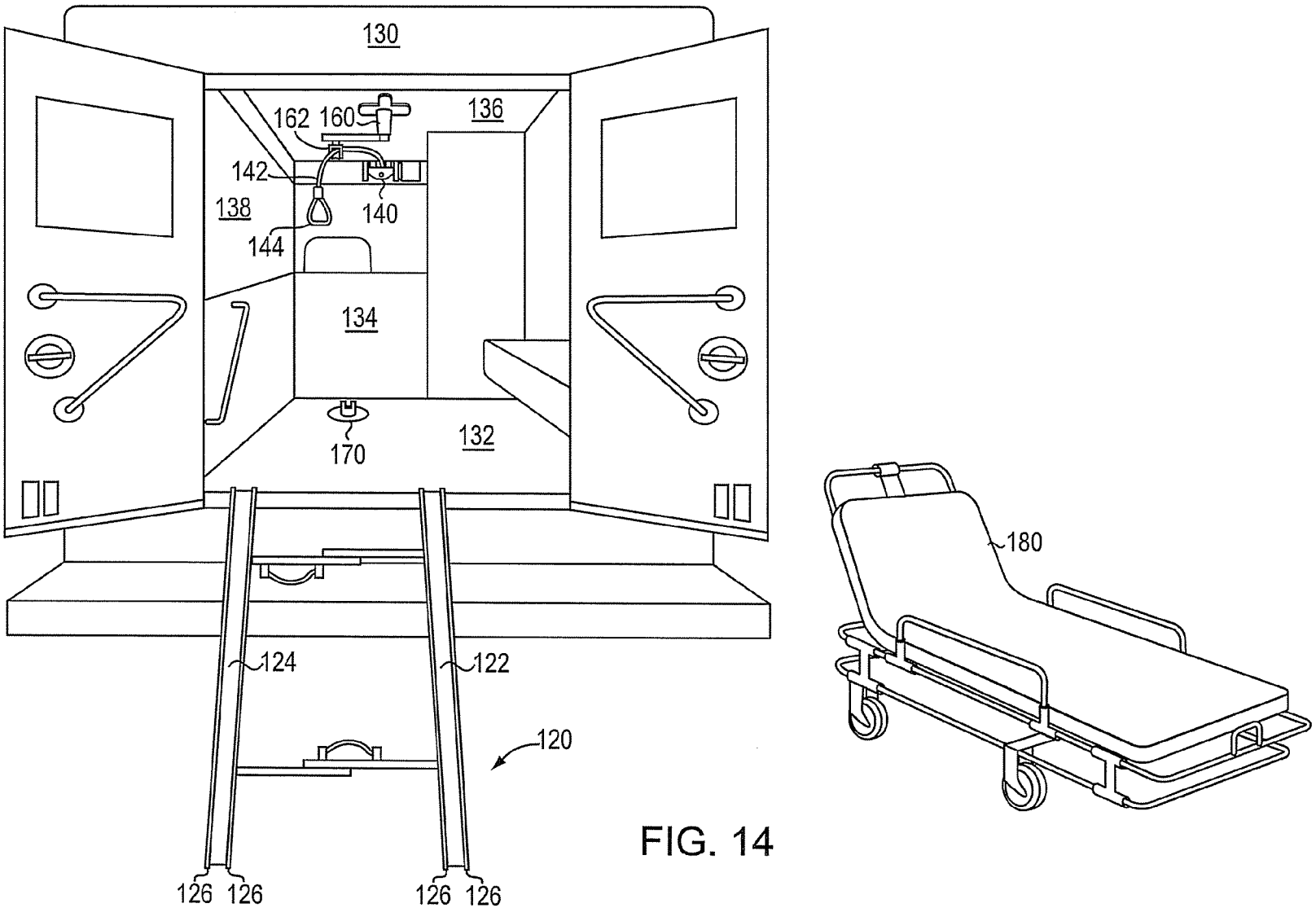
FIG. 14 is a perspective view of an example configuration with the ambulance loading ramp deployed and configured to accommodate the ambulance stretcher.
Figure 15:
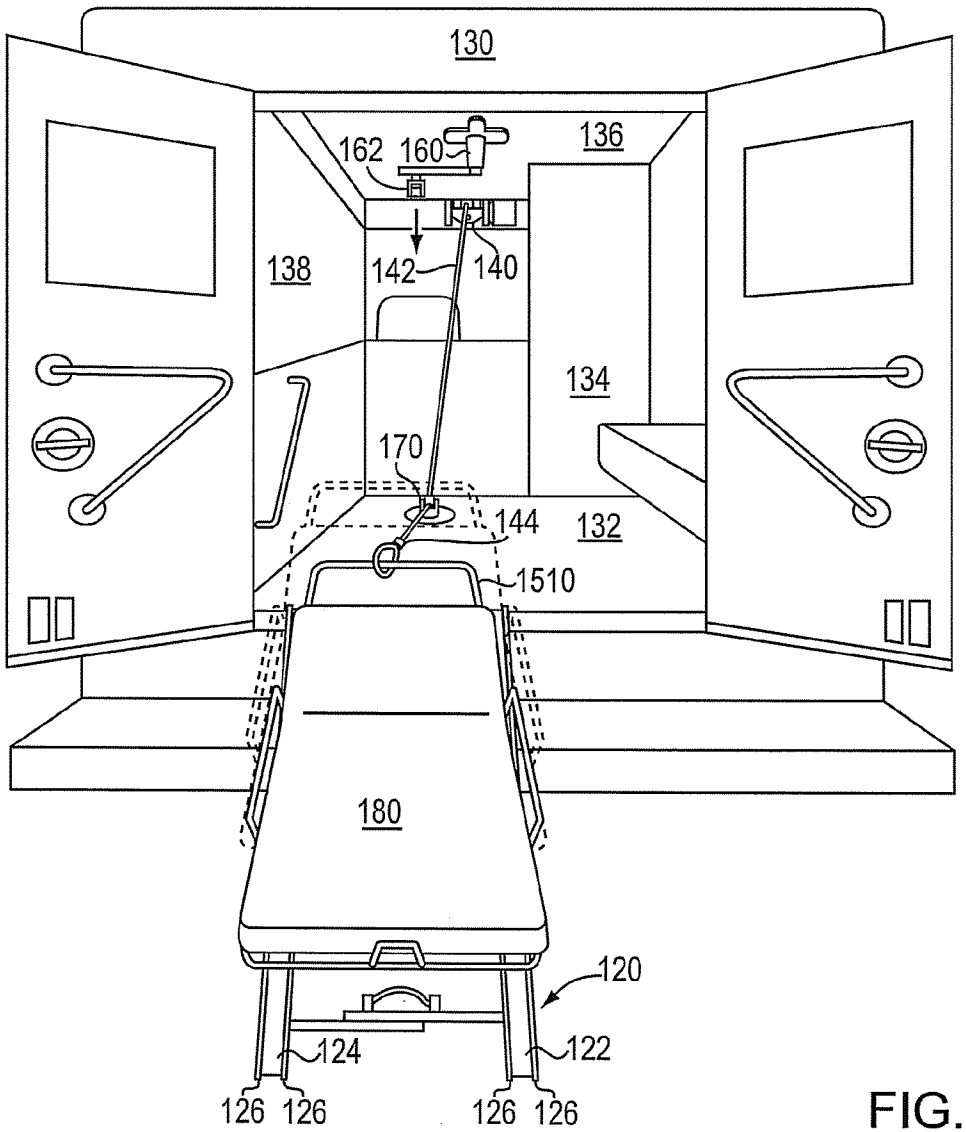
FIG. 15 is a perspective view of an example configuration with the ambulance stretcher in a first position, attached to the winch cable, beginning to be loaded into the rear of the ambulance.
Figure 16:
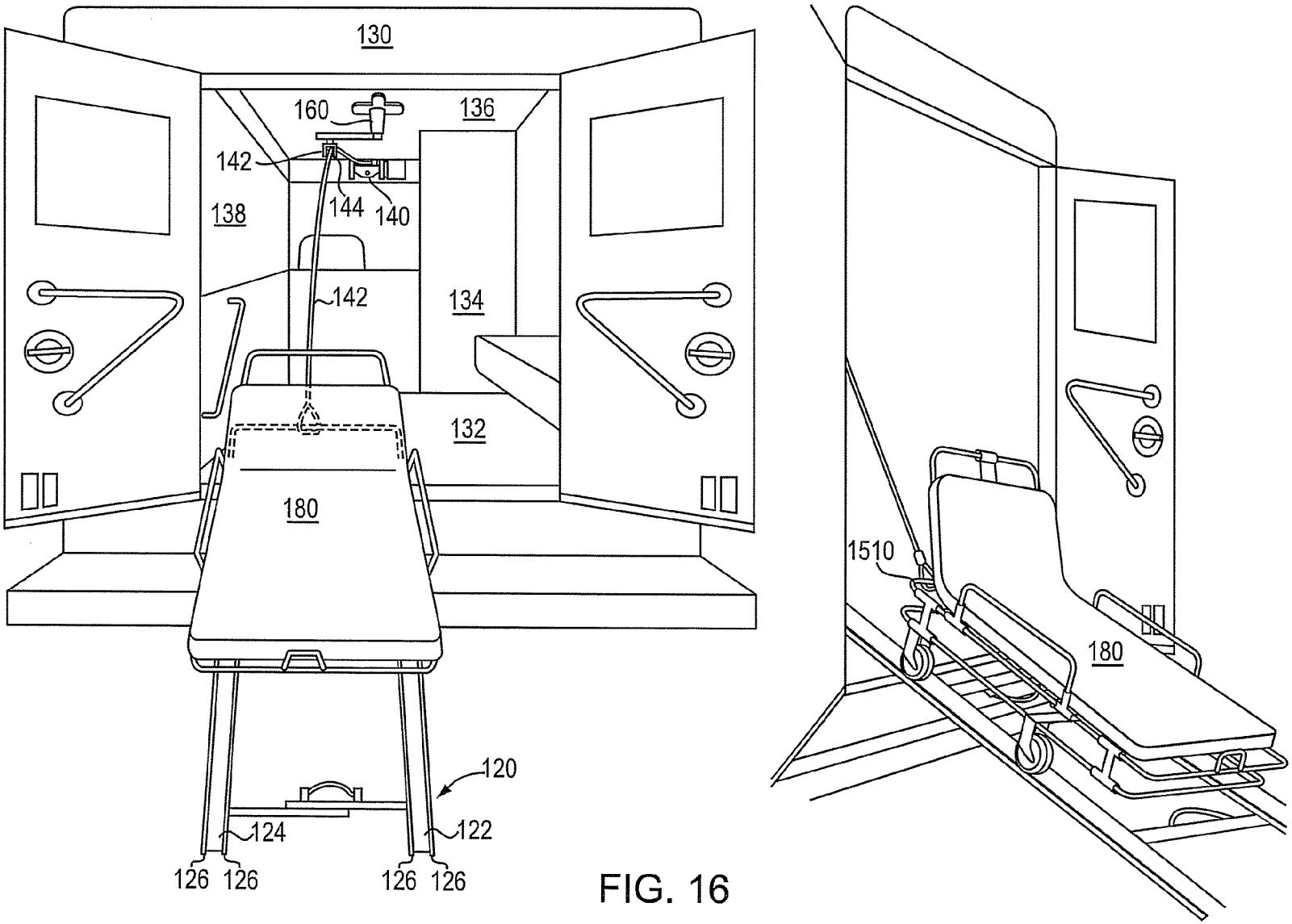
FIG. 16 is a perspective view of an example configuration with the ambulance stretcher in a second position, nearly loaded into the rear of the ambulance.
Figure 17:
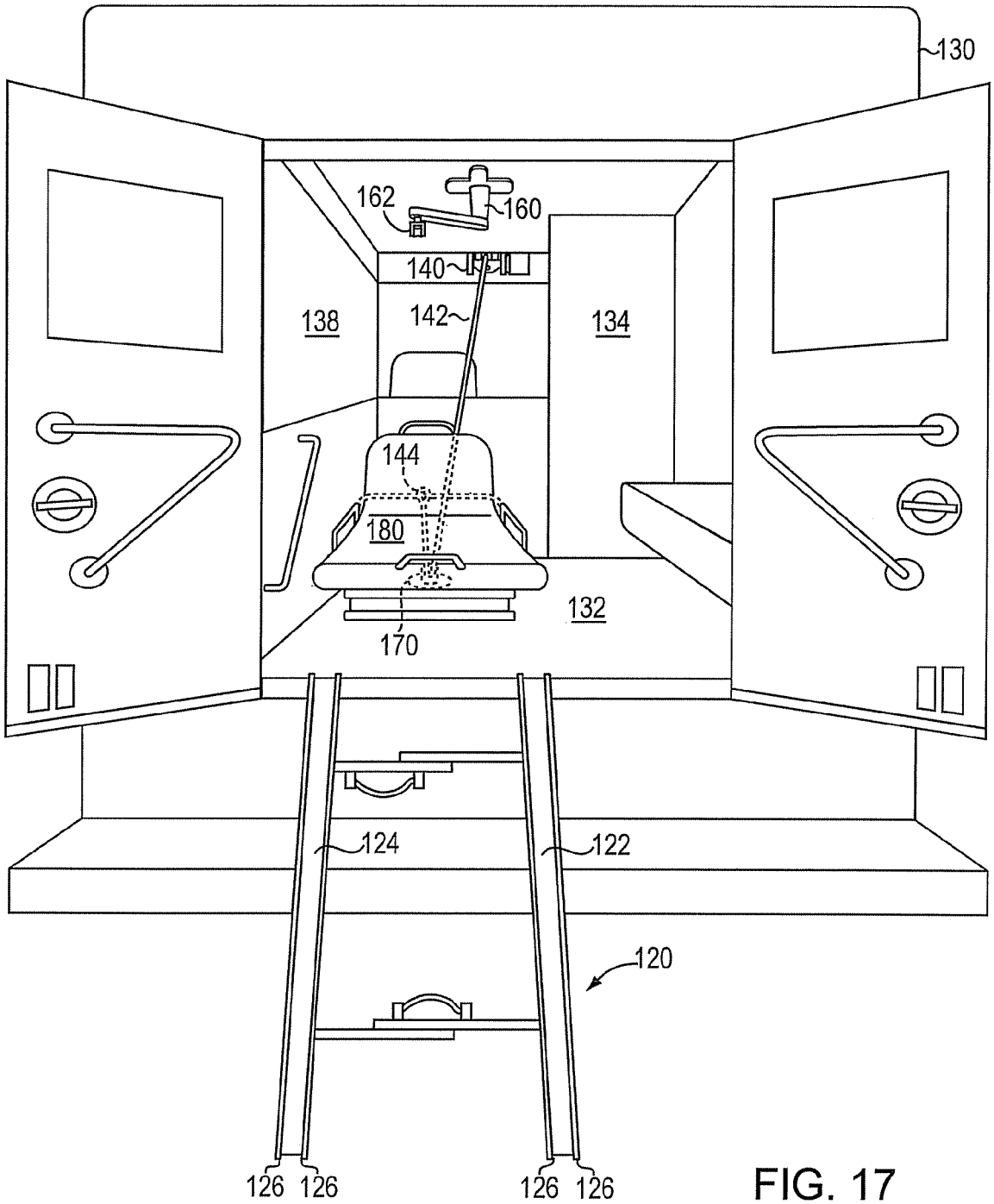
FIG. 17 is a perspective view of an example configuration with the ambulance stretcher in a third and final position, fully loaded into the rear of the ambulance.

At step 1310, an EMS crew arrives at the scene and determines only an ambulance stretcher 180 is to be used, for example, because there is sufficient open space to maneuver the ambulance stretcher 180 and, for example, it can be accommodated in elevators. At step 1320, the EMS crew deploys places the patient onto the ambulance stretcher 180. At step 1330, the EMS crew deploys the loading ramp 120 from the rear of the ambulance 130, and adjusts the ramp so that the first and second tracks 122, 124 are in a configuration that accommodates the spacing of the wheels of the ambulance stretcher 180. The results of step 1330 are shown in FIG. 14, which depicts an example configuration with the ambulance loading ramp 120 deployed and configured to accommodate the ambulance stretcher 180. At step 1340, if the winch cable 142 is not already so disposed, the cable is threaded through the second cable guide (fork) 170. After loading the patient in the ambulance stretcher 180 at the scene, and moving the patient and ambulance stretcher 180 proximate to the rear of the ambulance 130, the winch cable 142 is removably secured to a rail of the ambulance stretcher 180 with the carabineer 144, at step 1350. At step 1360, the winch 140 is activated, for example, by a remote control unit operated by an EMS crew member, and the patient and ambulance stretcher 180 are pulled up the loading ramp 120 into the rear of the ambulance 130. FIG. 15 depicts an example configuration with the ambulance stretcher 180 in a first position, attached the winch cable 142, beginning to be loaded into the rear of the ambulance 130. A portion of the ambulance stretcher 180 in FIG. 15 is cut away to show the second cable guide (fork) 170 and a rail 1510, to which the carabineer 144 is attached. FIG. 16 depicts an example configuration with the ambulance stretcher 180 in a second position, nearly loaded into the rear of the ambulance 130. FIG. 17 depicts an example configuration with the ambulance stretcher 180 in a third and final position, fully loaded into the rear of the ambulance 130. By completion of the sequence of steps 1300, transfer into the ambulance is completed absent significant manual exertion by the EMS crew.

It should be apparent that the patient and ambulance stretcher 180 may be unloaded from the rear of the ambulance 130 using similar techniques to those described in relation to FIG. 13, and merely reversing the direction of winch movement. Similarly, should one desire to do so, a patient in the ambulance chair 150 may be unloaded from the rear of the ambulance 130 using similar techniques to those described in relation to FIG. 7. Accordingly, the above described example patient movement apparatus may be used to not only load a patient into the ambulance 130 at the scene, and move the patient while within the ambulance, but also to assist in unloading the patient at a hospital or other medical facility.

While the above description discusses one or more embodiment of the present invention, it should be apparent that a number of modifications and/or additions may be made without departing from the invention's intended spirit and scope. For example, while it is discussed above that certain components of the patient moving apparatus are made from certain materials, it should be apparent that a wide range of alternative materials, including various plastics, metals, fabrics and the like may be employed. Accordingly, it should be understood that the above descriptions are meant to be taken only by way of example.

What is claimed is:

1. A patient moving apparatus for use with an ambulance, comprising:

a patient cradle having a flexible seat configured to wrap about a portion of a patient and one or more lifting straps secured to the flexible seat, the patient cradle separate from an ambulance chair of the ambulance;

a loading ramp configured to span a distance between ground level and a level of a floor of a rear of the ambulance, the loading ramp configured to accommodate wheels of the ambulance chair;

a winch with a retractable winch cable, the winch secured within the rear of the ambulance, the winch cable having an attachment mechanism configured to removably attach to an attachment point located on a rearward side of the ambulance chair and, when not attached to the attachment point located on a rearward side of the ambulance chair, to the one or more lifting straps, the winch having sufficient strength to, when the winch cable is attached to the attachment point on the ambulance chair, draw the ambulance chair and the patient disposed therein up the loading ramp and into the rear of the ambulance, and when the winch cable is attached to the one or more lifting straps, lift the patient and patient cradle for transfer to an ambulance stretcher; and an articulating arm having a pulley to support the winch cable, the articulating arm separate from the winch and secured within the rear of the ambulance at a location between the winch and a rear door of the ambulance, the articulating arm capable of rotation through an arc while maintaining the pulley at a level higher than the ambulance chair, and the articulating arm configured to rotate sufficiently such that the patient and the patient cradle may be lifted from the ambulance chair by the supported winch cable, rotated to be disposed over the ambulance stretcher, and lowered upon the ambulance stretcher by the supported winch cable, upon operation of the winch.

2. The patient moving apparatus of claim 1 wherein the loading ramp comprises:

a first track;

a second track parallel to the first track; and one or more crossbars that couple the first track and the second track, the one or more crossbars including sliding members that, when slid, adjust separation between the first track and the second track, from a separation that accommodates wheels of the ambulance chair to a separation that accommodates wheels of the ambulance stretcher.

3. The patient moving apparatus of claim 1 further comprising:

a double-roller mechanism coupled to the winch, the double-roller mechanism having first and second laterally-mounted rollers, the first and second rollers spaced sufficiently from one another for the winch cable to pass between the first and second rollers, but to otherwise restrict substantial lateral movement of the winch cable as the winch cable is fed toward a spool of the winch.

4. The patient moving apparatus of claim 1, further comprising:

a first cable guide having a pulley to accommodate the winch cable, the first cable guide disposed on a ceiling of the rear of the ambulance.

5. The patient moving apparatus of claim 1, further comprising:

a second cable guide having a pulley to accommodate the winch cable, the second cable guide disposed on the floor of the rear of the ambulance.

6. The patient moving apparatus of claim 1, wherein the winch is a remote-controlled, electrically powered winch.

7. The patient moving apparatus of claim 1, wherein the winch is mounted to a front wall of the rear of the ambulance.

8. The patient moving apparatus of claim 1, wherein the articulating arm is secured to the ceiling of the rear of the ambulance.

9. The patient moving apparatus of claim 1, wherein the articulating arm further comprises:

a housing configured to house the pulley;

a rotating member coupled at one end to a pivot and at another end to the housing, the rotating member configured to rotate between multiple positions thereby moving the pulley, including a first position suitable for lifting the patient and the patient cradle from the ambulance chair, and a second position suitable for lowering the patient and the patient cradle upon the ambulance stretcher.

10. The patient moving apparatus of claim 1 wherein the attachment mechanism is a carabineer.

* * * * *